US008124902B2

(12) United States Patent
Watanabe

(10) Patent No.: US 8,124,902 B2
(45) Date of Patent: Feb. 28, 2012

(54) PUSH BUTTON SWITCH

(75) Inventor: Masashi Watanabe, Fujiyoshida (JP)

(73) Assignee: Citizen Electronics Co., Ltd, Yamanashi (JP)

( * ) Notice: Subject to any disclaimer, the term of this patent is extended or adjusted under 35 U.S.C. 154(b) by 455 days.

(21) Appl. No.: 12/370,647

(22) Filed: Feb. 13, 2009

(65) Prior Publication Data

US 2009/0201655 A1 Aug. 13, 2009

(30) Foreign Application Priority Data

Feb. 13, 2008 (JP) ..... 2008-031654

(51) Int. Cl.
*H01H 5/18* (2006.01)

(52) U.S. Cl. ..... 200/406; 200/534

(58) Field of Classification Search ..... 200/406, 200/534, 542, 573
See application file for complete search history.

(56) References Cited

U.S. PATENT DOCUMENTS 6,495,783 B2 * 12/2002 Rochon et al. ..... 200/406
7,022,928 B2 * 4/2006 Watanabe et al. ..... 200/406
7,449,654 B2 * 11/2008 Tsuduki ..... 200/406
7,525,059 B2 * 4/2009 Masuda et al. ..... 200/406
7,547,858 B2 * 6/2009 Nagata ..... 200/520
7,741,573 B2 * 6/2010 Masuda et al. ..... 200/406

FOREIGN PATENT DOCUMENTS

JP 2005-209565 8/2005
JP 2006-244977 9/2006

* cited by examiner

*Primary Examiner* — Anh Mai
*Assistant Examiner* — Lisa Homza
(74) *Attorney, Agent, or Firm* — Browdy and Neimark, PLLC

(57) ABSTRACT

A push button switch includes a base part (22) provided with a snap dome (23*b*) and a fixed contact (23*a*), a cover member (24) disposed to cover the base part (22) and having at one side surface an opening (42), an operating controller (25) disposed to slide inside the opening (42) in a lateral direction and configured to press the snap dome (23*b*) downwardly. The cover member (24) includes side extended potions (36) provided to extend downwardly from the cover member (24) along side surfaces of the base part across the operating controller (25) in a direction perpendicular to a sliding direction of the operating controller (25). Lower end portions of the side plate portions (36) are provided with extensions (38) disposed adjacent to some of the solder pad portions (41) provided on a lower surface of the base part (22).

16 Claims, 6 Drawing Sheets

PUSH BUTTON SWITCH

CROSS-REFERENCE TO THE RELATED APPLICATION

The application is based on and claims the priority benefit of Japanese Patent Application No. 2008-31654, filed on Feb. 13, 2008, the entire description of which is incorporated herein by reference.

BACKGROUND OF THE INVENTION

1. Field of the Invention

The present invention relates to a push button switch, especially to a lateral-push button switch used in small electronic equipment and devices such as mobile phones, portable game devices, digital cameras, mobile personal computers, and so on.

2. Description of the Related Art

A conventional general lateral-push button switch includes a circuit board provided with a fixed contact and a resilient snap dome as a base part, a cover covering the base part of the push button switch and having at a peripheral side surface of the push button switch an opening, and an operating controller inserted in the opening to be disposed slidably in a lateral horizontal direction and configured to press the snap dome toward the fixed contact downwardly (for reference, see Japanese Patent Application Publication Nos. 2006-244977 and 2005-209565).

The base part includes a molded article in which a flat plate-like circuit board or lead frame is formed by insert molding, and the circuit board includes a plurality of solder pads which are provided on a lower surface of the circuit board and electrically connected to the fixed contact and the snap dome. The cover member includes a slope extending inward from an upper part of the cover member, and the slope is inclined to press the operating controller from obliquely above when the operating controller is laterally slid into the push button switch.

When the operating controller is pressed and laterally slid into the push button switch, a leading end portion or inner end portion of the operating controller is downwardly guided and pressed from obliquely above by the slope, and the snap dome comes into contact with the fixed contact.

In this way, by sliding the operating controller in a lateral direction, the snap dome with the fixed contact is configured to execute switch-on and -off operations.

In the push button switch having the aforementioned structure, the cover member is fixed to the base part to cover the snap dome and the fixed contact. The push button switch used in an electronic device is mounted on a motherboard of an electronic device by bonding the base part onto the motherboard directly through soldering.

Because thinning is required in small electronic devices in each of which a push button switch is surface-mounted on a motherboard of the electronic devices, the push button switch is also required to be thin. When the push button switch is surface-mounted on an electronic device, the fixation and the electric connection of the push button switch to the motherboard of the small electronic equipment are simultaneously executed by a reflow process.

However, in the lateral-push button switch having the aforementioned structure, because a user's pushing force on the operating controller that is pressed against the slope of the covering member accompanies performance of the switch-on and -off operations of the snap dome and the fixed contact, it is necessary to increase the strength of the cover member to a certain extent relative to the base part provided with the snap dome and the fixed contact or a motherboard on which the push button switch is finally mounted in an electronic device. In addition, the lateral-push button switch is often installed in small electronic devices such as mobile phones, portable game devices, digital cameras, mobile personal computers and so on as a lateral-push button switch provided at a side surface of the electronic device. However, because a user carries around a mobile phone and other small electronic devices as portable devices, it often happens that the small electronic devices are accidentally dropped or hit on an object, and strong impacts and large stresses often cause problems in the switch function of the push button switch or physical destruction.

In most cases the destruction begins first from a side surface of a cover member, the side surface facing a sliding direction of the operating controller, and thereafter reaches the base part provided with the snap dome and the fixed contact. Therefore, it is necessary to particularly increase strength of a portion of the push button switch close to a switch operation part exposed on a side surface of the mobile phone and other electronic devices.

Furthermore, because the push button switch is finally surface-mounted on the motherboard of an electronic device, it is often bonded by solder in a reflow process. In the reflow process, joint strength tends to increase in proportion to a size of solder-joining area. Therefore, a process of securing a large solder-joining area of the base part of the push button switch to the motherboard has conventionally been executed. However, if the solder-joining area of the circuit board becomes larger, for example, the circuit board and the push button switch become larger which goes against the demand for thinner and smaller push button switches to be mounted in small electronic devices such as mobile phones and other portable electronic devices. Also, if the base part is formed by inserting a lead frame, it is not easy to ensure a large solder-joining area, because a size of electrodes is previously determined.

SUMMARY OF THE INVENTION

An object of the present invention is to provide a push button switch reducing a mounting space of a motherboard on which the push button switch is mounted, and a push button switch that is impact resistant, prevented from being destroyed and becoming detached from the motherboard even if a large impact due to dropping or hitting is applied to an electronic device in which the push button switch is disposed.

To accomplish the above object, a push button switch according to one embodiment of the present invention includes a base part, a fixed contact provided on the base part, a snap dome provided on the base part to cover the fixed contact, a cover member disposed to cover at least one portion of the base part, an operating controller disposed in the base under the cover member and configured to perform switch-on and -off operations of electrical connection between the snap dome and the fixed contact, and the cover member including at least a pair of side extended portions extending downwardly along sides of the base part, and extensions extending laterally along a same level of a lower surface of the base part. The base part includes at a lower surface thereof solder pad portions, and at least two of the solder pad portions are electrically connected to the snap dome and the fixed contact.

Further, each of the extensions of the cover member includes a lower surface extending in a same plane as a lower surface of each of the solder pad portions. A solder pad portion of the circuit board is disposed adjacent to each of the extensions. The solder pad portions adjacent to the extensions are provided on the lower surface of the base part, positioned at both sides of the opening in which the operating controller is inserted.

In an electronic device including a push button switch according to the present invention, the extensions and the adjacent solder pad portions are fixed together to a motherboard of the electronic device. Other solder pad portions provided on the lower surface of the circuit board of the push button switch may be used for electrical connection and also used to fix the push button switch to the motherboard.

DETAILED DESCRIPTION OF THE PREFERRED EMBODIMENTS

Figure 1:
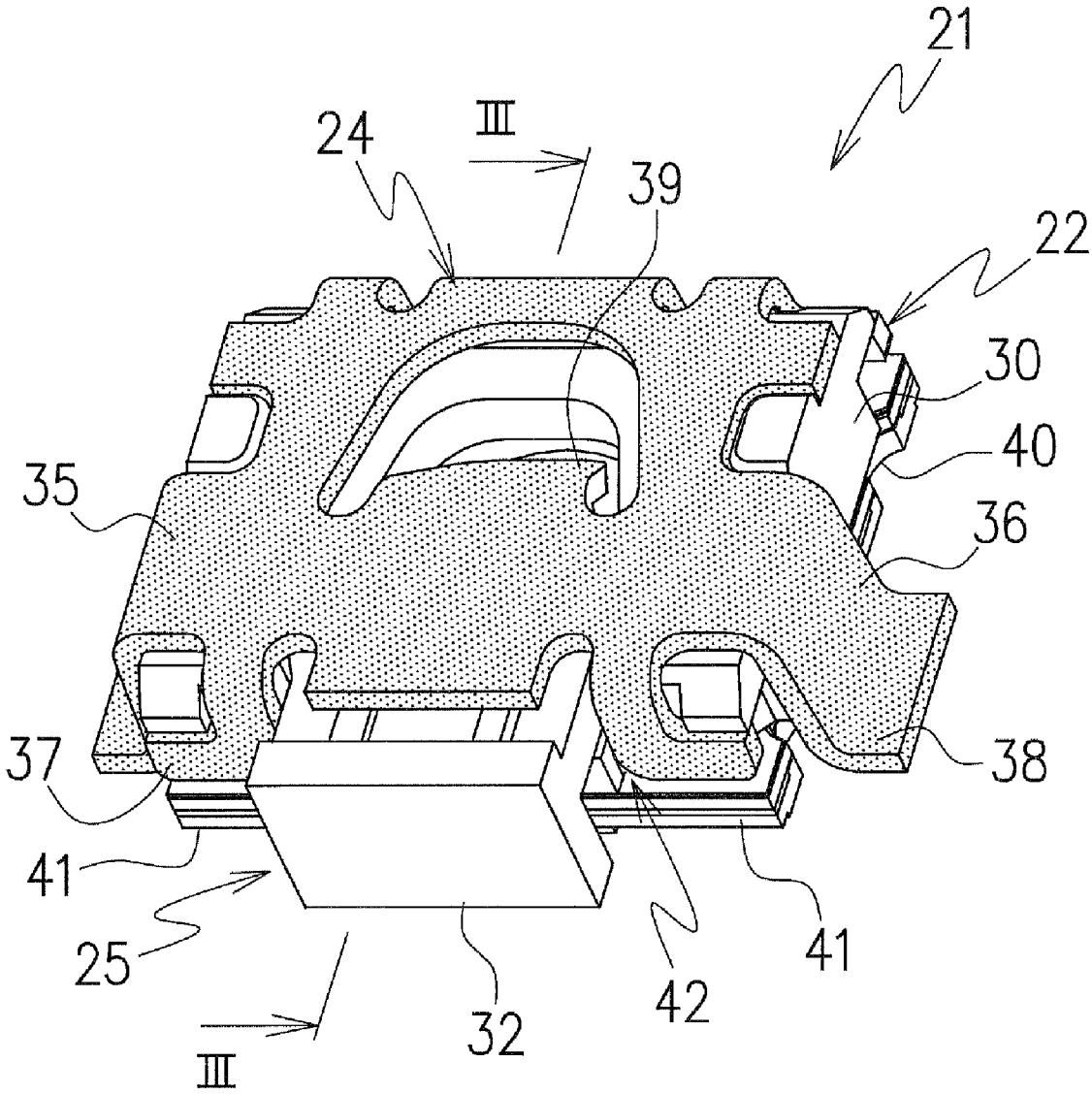
FIG. 1 is a perspective view showing an upper side or cover-member side of a push button switch according to one embodiment of the present invention, as viewed from above.
Figure 2:
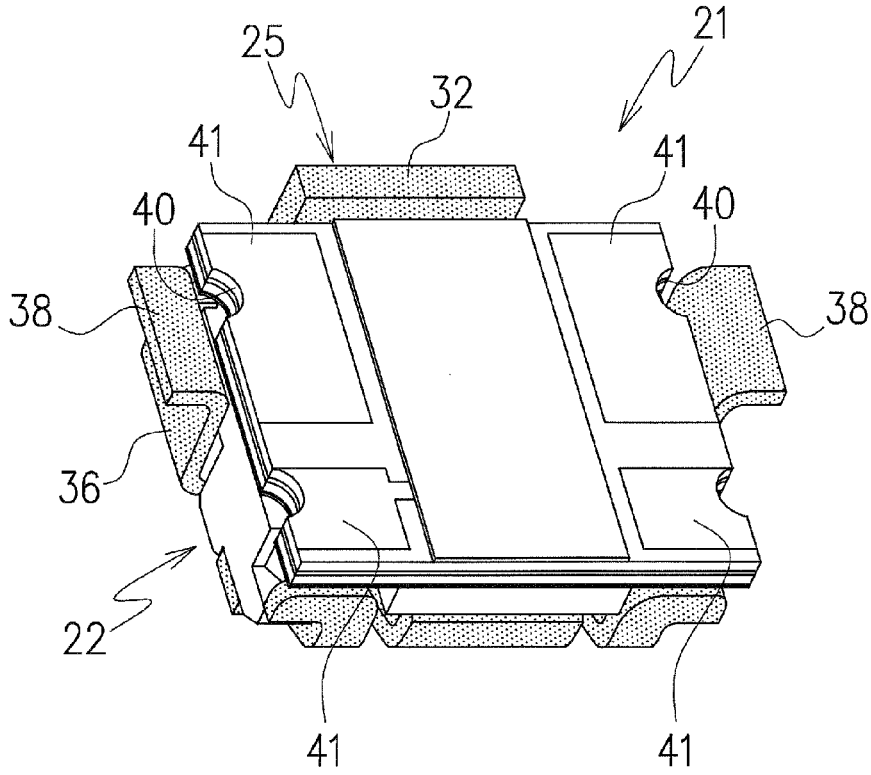
FIG. 2 is a perspective view showing a lower side or circuit board side of the push button switch, as viewed from above.
Figure 3:
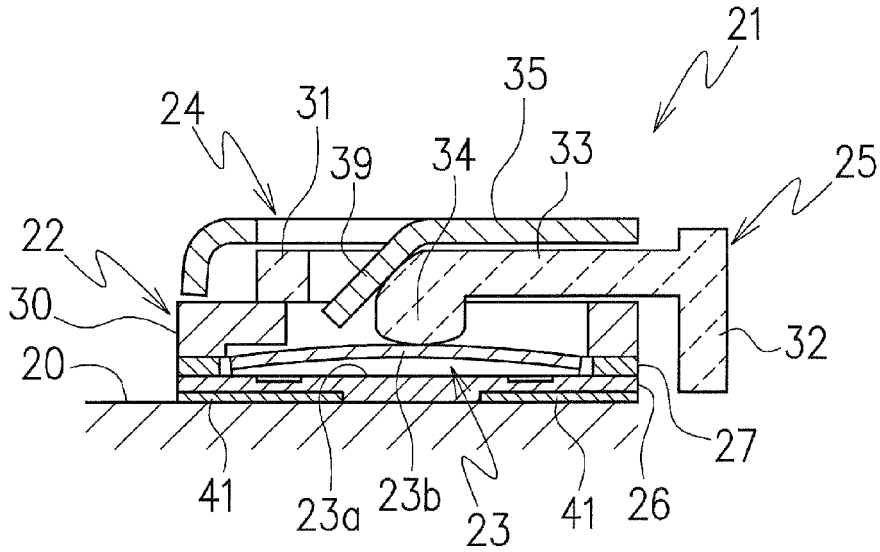
FIG. 3 is a sectional view of the push button switch taken along line III-III line in FIG. 1.

FIGS. 1 to 3 illustrate a push button switch 21 according to one embodiment of the present invention.

FIG. 3 shows a push button switch 21 mounted on a motherboard of an electronic device. The push button switch 21 has a predetermined mounting area, for example, square mounting portions M (see FIG. 5), each of which includes an electrode or a solder pad portion provided on a lower surface of the circuit board, and two of the solder pad portions adjacently disposed to lower surfaces of extensions of a cover member, respectively. The two soldering portions each include a solder pad portion and an extension extended from the cover member. The push button switch 21 includes, as a base part 22, a circuit board 26, a fixed contact 23*a* disposed on an upper surface of the circuit board 26, a snap dome with elasticity disposed on the upper surface of the circuit board over the fixed contact 23*a*, and a cover member 24 disposed to cover the base part 22 and the push button switch having an opening at a side surface thereof between the cover member and the base part 22, and an operating controller 25 that is inserted in the opening and slidably disposed above the base part 22 under the cover member 24, in other words, the operating controller slidably disposed inside the push button switch and configured to press at an inner end of the operating controller the snap dome 23*b* from above, resulting in an electrical connection between the fixed contact 23*a* and the snap dome 23*b* (see FIG. 3).

The operating controller 25 includes a push-button part 32 that receives a lateral pressing force to move the operating controller 25 laterally in the push button switch to make an electrical connection of the switch unit 23. When the push button switch 21 is used in an electronic device such as a mobile phone, the circuit board 26 of the push button switch 21 is electrically mounted on a motherboard 20 of the electronic device, and the push-button part 32 of the push button switch 21 is disposed on an outside surface of a housing of the electronic equipment, so that a user can push the push-button part 32. The push-button part 32 may be disposed to appear at a side surface of a housing of an electronic device when the push button switch is mounted in the electronic device. The snap dome 23*b* and the fixed contact 23*a* are electrically connected or disconnected in accordance with movements of the operating controller 25 (see FIG. 3). When the operating controller 25 presses the snap dome 23*b* from above, the snap dome 23*b* is pressed to be in contact with the fixed contact 23*a*, and when the push-button part 32 of the operating controller 25 is released, the snap dome 23*b* is released and resiliently returns to an original position that is electrically disconnected from the fixed contact 23*a*.

Figure 4:
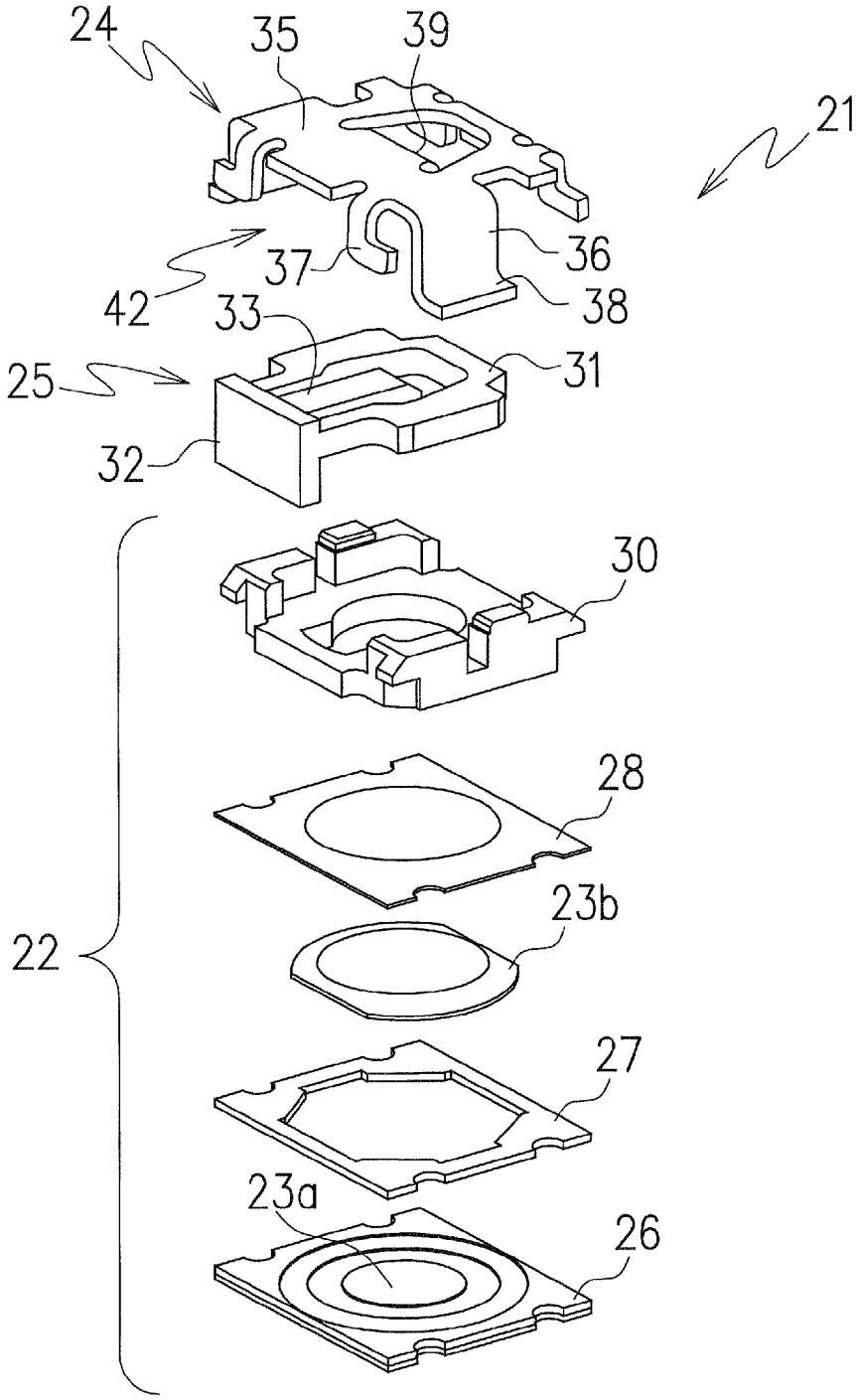
FIG. 4 is an exploded perspective view of the push button switch.

FIG. 4 illustrates an exploded perspective view of a push button switch 21 according to an embodiment of the present invention. The base part 22 includes a circuit board 26 which has, for example, a substantially square shape and is provided with a fixed contact 23*a* having, for example, a circular shape, a base sheet 27, which has a substantially annular shape, disposed on a peripheral portion of the upper surface of the circuit board 26, with the fixed contact 23*a* being disposed in a center of the annular shape, the resilient snap dome 23*b* having a generally dome-like shape and being disposed on the upper surface of the circuit board 26 over the fixed contact 23*a* and the snap dome 23*b* at a center thereof disposed vertically away from the fixed contact 23*a* as an initial position (see FIG. 3), a water-proof protection sheet 28 covering the snap dome 23*b*, and a mold frame 30 including a hole that vertically passes through the frame 30 and a concave portion to receive the operating controller 25 from a lateral direction.

The circuit board 26 is made of a resin such as glass epoxy or the like and provided with wiring patterns disposed on the upper surface of the circuit board 26 and electrically connected to the snap dome 23*b* and the fixed contact 23*a*. The circuit board 26 also includes at least two through-hole electrodes 40 electrically connected to the wiring patterns, the through-hole electrodes 40 being disposed at a peripheral side surface of the circuit board 26 and extending from the upper surface to the lower surface of the circuit board (see FIG. 6). In the illustrated embodiment, four through-hole electrodes 40 are provided adjacent to four corners of the circuit board 26. Four through-hole electrodes 40 are extended to four solder pad portions 41 on the lower surface of the circuit board 26, and the four solder pad portions 41 may be fixed to a motherboard 20 of an electronic device. The switch unit 23 is electrically connected to a motherboard through at least two solder pad portions 41 and other solder pad portions 41 may be dummy electrodes that can be used to fix the push button switch to the motherboard (see FIGS. 1, 3 and 5). The solder pad portions 41 are formed, for example, by applying metallic plating on the lower surface of the circuit board 26 and some of the solder pad portions 41 are disposed adjacent to at least two lower surfaces of extensions 38 of the covering member 24 that are extended to a same level of the lower surface of the circuit board 26 or the solder pad portions 41. The two solder pad portions 41 and adjacent disposed two lower surfaces of the extensions 38 of the covering member 24 are two solder-pad-portion-extension-connecting mounting portions M that are fixed to a motherboard of an electronic device. In addition, other two solder pad portions 41 can be fixed to the motherboard and may be used for electrical connection to the motherboard.

The snap dome 23*b* is, for example, an electrically conductive plate-like spring or a dome-like spring and is formed by a thin resilient plate of a metallic material such as stainless steel (SUS), brass, and so on. The snap dome 23*b* has a central portion which comes into contact with the fixed contact 23*a*, when being pressed by the operating controller from above. The operating controller 25 is laterally slid into the inside of the push button switch and an inner end of the operating controller 25 is pressed from above by a part of the cover member 24, when the push-button part 32 of the controller 25 is pressed. In a usual state, the snap dome 23*b* is disposed in an upwardly slightly inflated dome-like shape so as not to be in contact with the fixed contact 23*a* and positioned at a central portion of the circuit board 26 by the base sheet 27 (see FIG. 3).

The operating controller 25 includes a plunger 31 and a press stick 33 that laterally extend from an inner surface of the push-button part and are disposed in the concave portion of the mold frame 30 of the base part 22. Even if the plunger 31 and the press stick 33 are contained in the mold frame 30, the push-button part 32 is disposed outside the mold frame 30. The press stick 33 laterally extends from a central part of the inner surface of the push-button part 32, and an inner end of the press stick 33 is formed into a free end portion. The free end portion of the press stick 33 is provided with a pressing portion, for example, a protrusion 34 which is positioned above a top of the snap dome 23*b* at a generally central portion of the base part 22 of the push button switch (see FIG. 3).

The cover member 24 is configured to cover the plunger 31, the press stick 33, and the mold frame 30 and the cover member 24 has at least two portions around side surfaces of the base part 22 downwardly extended to a level of the lower surface of the circuit board 26. The side downwardly extended portions of the cover member 24 at downward ends thereof may have extensions 38 laterally extended along the level of the lower surface of the circuit board 26. The cover member 24 includes an opening 42 into which the plunger 31 is inserted, a top panel portion 35 covering the plunger 31, side extended portions 36 configured to extend downwardly from opposite sides of the top panel portion 35 to the circuit board 26 across the operating controller 25, a plurality of engaging portions 37 that extend downwardly and engage with the mold frame 30, and extensions 38 which extend approximately horizontally from lower ends of the side extended portions 36, outwardly from the circuit board 26 (see FIG. 4).

The cover member 24 is formed by, for example, punching or folding one metallic plate. The top panel portion 35 includes a slope 39 that is a part of the top panel portion 35 and the slope 39 is inclined toward inside a central portion of the push button switch to be in contact with an upper surface of the protrusion 34 of the operating controller 25. The slope 39 is configured to press the protrusion 34 of an inner open end of the press stick 33 of the plunger 31 toward the snap dome 23*b* which is disposed downwardly, when the plunger 31 is laterally pressed into the mold frame 30 by pressing the pressing section 32 to electrically connect the snap dome 23*b* and the fixed contact 23*a* (see FIG. 7). In the embodiment, a surface of the protrusion 34 of the pressing section 32, contacting with the slope 39 has an inclined surface along the slope 39 (see FIG. 3).

In the aforementioned push button switch 21, the base part 22 is placed on the motherboard 20 and the four solder pad portions 41 are downfacing and bonded on a predetermined mounting area of the motherboard 20 by soldering through a reflow process.

Figure 5:
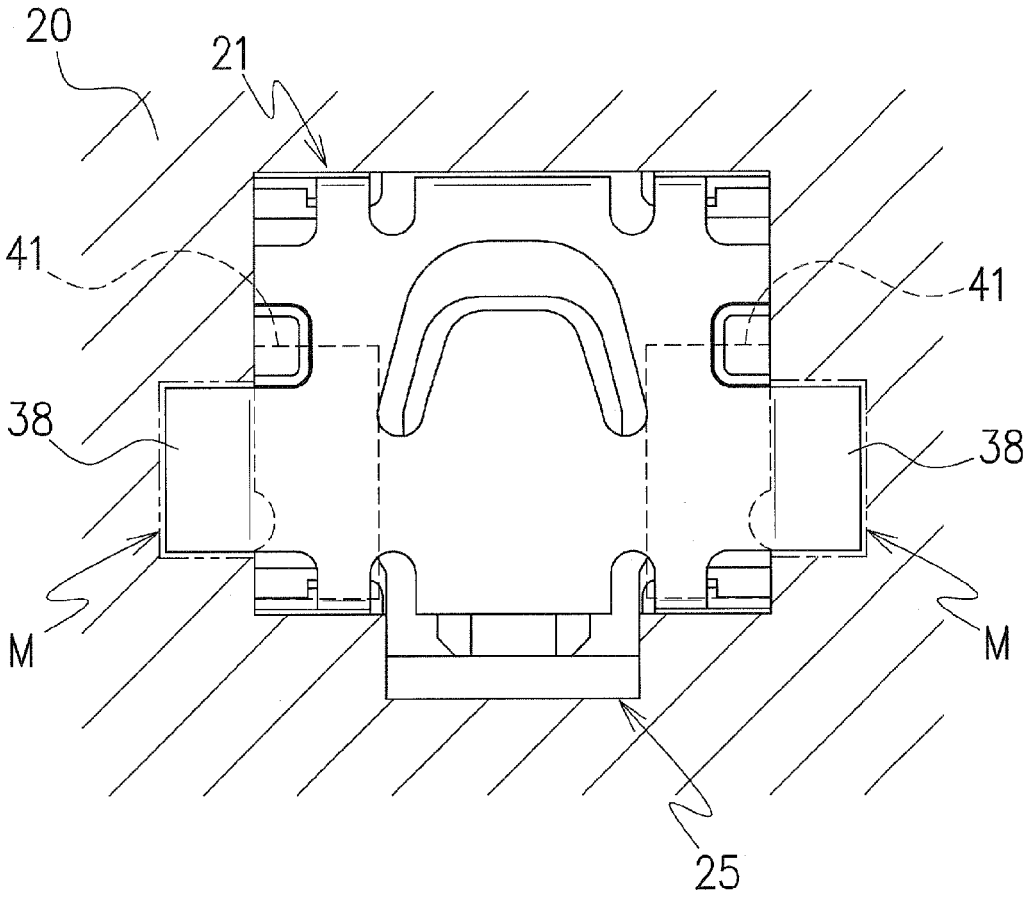
FIG. 5 is a plan view showing an upper side or cover-member side of the push button switch disposed on a motherboard of an electronic device, as viewed from above.
Figure 6:
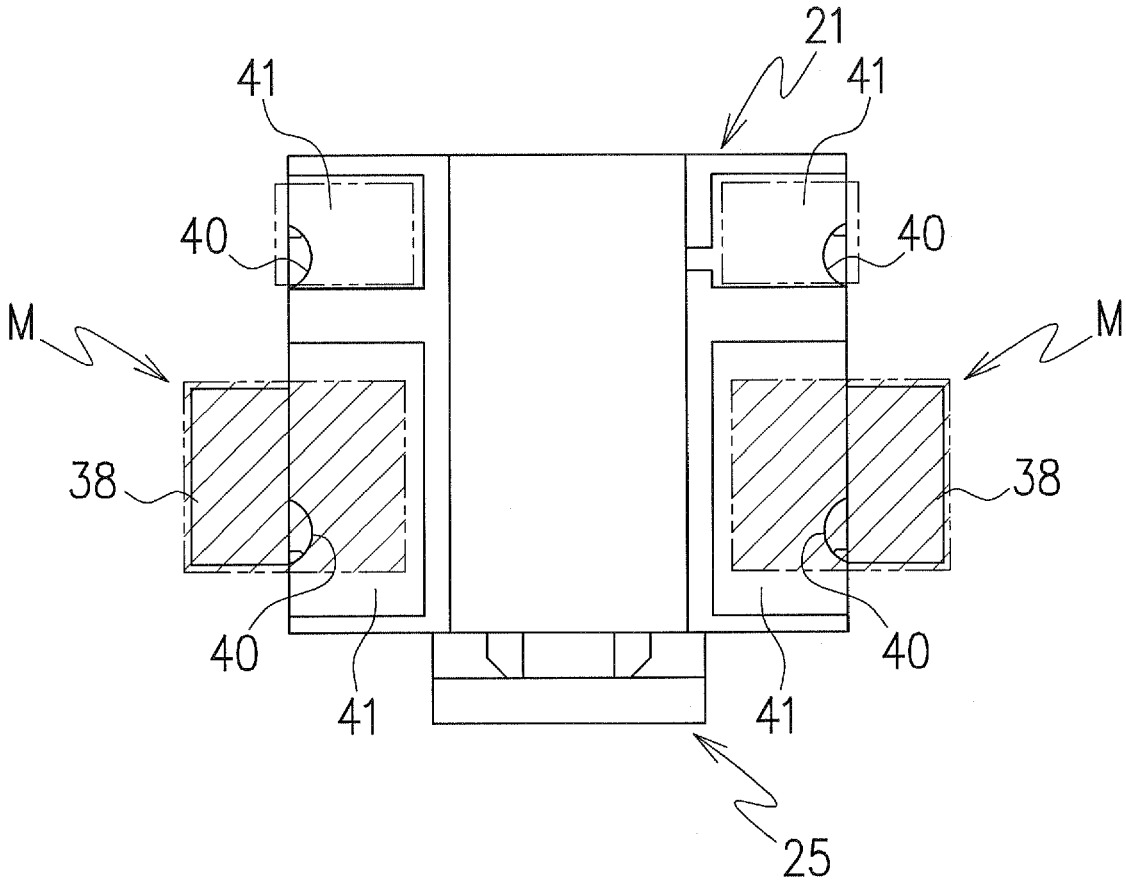
FIG. 6 is a plan view showing a lower side or circuit board side of the push button switch, showing solder-joining portions to the motherboard.

In a lateral-push button switch 21 having the aforementioned structure, the most important feature of the present invention is that the extensions 38 of the cover member 24 are disposed adjacent to some of the solder pad portions 41 formed at a lower surface of the circuit board 26, and the extensions 38 are disposed adjacent to the solder pad portions 41, and the side extended portions 36 and extensions 38 of the cover member 24 are positioned across a sliding direction of the operating controller 25, as shown in FIGS. 2, 5 and 6. The extensions 38 may be disposed near the side where the push-button part 32 of the operating controller 25 is disposed. In addition, lower surfaces of the extensions 38 of the side extended portions of the cover member 24 are in a same plane as that of the circuit board 26 or that of each of the solder pad portions 41.

In this way, by disposing the extensions 38 of the cover member 24 adjacent to some of the solder pad portions 41 of the base part 22, the extensions 38 and the adjacent solder pad portions 41 can be firmly bonded together as mounting portions M to the motherboard 20 simultaneously, and thus the cover member 24 or the base part 22 can be prevented from failing or becoming detached from the motherboard 20 even if a large external force is applied to the push button switch 21.

Figure 7:
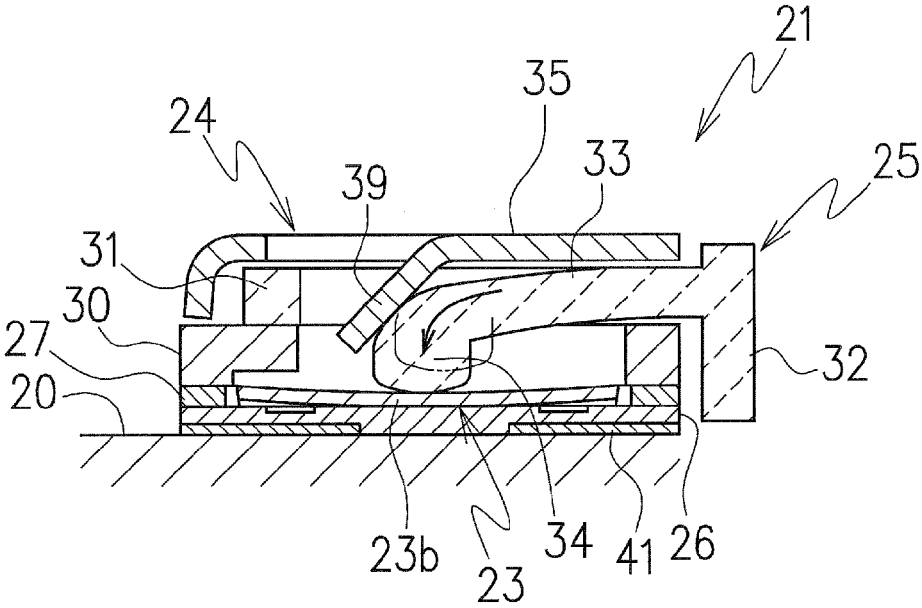
FIG. 7 is an operative view showing a state of a usual switch-on operation in a push button switch.

An operational effect of the push button switch 21 having the aforementioned structure in the case of a usual switch-on operation and where a large impact is applied is described hereinafter with reference to FIGS. 3, 7 and 8. Here, FIG. 3 illustrates a state where the snap dome 23*b* and the fixed contact 23*a* are not electrically connected, and FIG. 7 illustrates a state where the snap dome 23*b* and the fixed contact 23*a* are electrically connected. FIGS. 3 and 7 illustrate states in a usual switch operation. On the other hand, FIG. 8 illustrates in section a state where a large external force is applied to the push button switch 21 from an operation side, in other words, the side of the push button part of the operating controller, when the electronic device in which the push button switch 21 is mounted is dropped.

As shown in FIG. 3, in a state where the operating controller 25 is not pressed toward the snap dome 23*b* and the fixed contact 23*a*, the leading end portion of the press stick 33 abuts with the slope 39 of the cover member 24, but because the snap dome 23*b* is not pressed, an external force is not applied to either of the base part 22 or the cover member 24. From this state, when the push-button part 32 of the operating controller 25 is pressed, as shown in FIG. 7, the protrusion 34 of the leading portion of the operating controller 25 descends along the slope 39 provided on the cover member 24 to press the resilient snap dome 23*b* down toward the fixed contact 23*a* against the resilience of the snap dome 23*b*.

By this operation, a reaction force from the snap dome 23*b* is imparted to the cover member 24, but because the cover member 24 is bonded at the extensions 38 of the cover member 24 onto the motherboard 20, a usual switch-on operation of the snap dome 23*b* and the fixed contact 23*a* can be achieved stably. Even when the push-button part 32 of the operating controller 25 is released, the switch-off operation between the snap dome 23*b* and the fixed contact 23*a* can similarly be accomplished stably.

Figure 8:
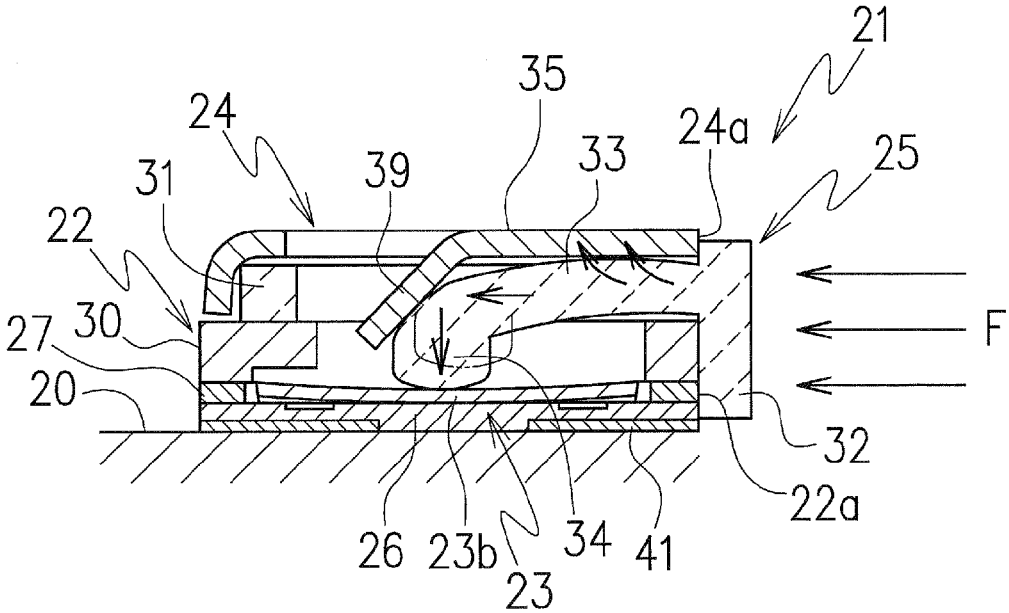
FIG. 8 is an operative view showing a state in which a large external lateral force is applied to a push button switch.

In a situation of accidentally dropping or hitting of an electronic device in which the push button switch 21 is mounted, if an excessively large external force which is more than a pressing force due to usual switch-on and -off operations is applied to the push-button part 32, a part of an inner surface of the push-button part 32 collides with a side portion 22*a* of the base part 22 or an edge portion 24*a* of the cover member 24, as shown in FIG. 8. In the bonding structure of the aforementioned conventional push button switches, if such a large laterally pressing force F (see FIG. 8) is applied to the conventional push button switch, the base part, the cover member and the portions fixed to the motherboard receive a large stress, and consequently, the conventional push button switch tends to become detached from the motherboard. This is the reason that bonded positions of the base part and the cover member to the motherboard come loose, and therefore an impact force due to the external force F concentrates at either one of the base part or the cover member, in the conventional push button switch.

However, in the push button switch 21 according to the present invention, as mentioned above, the extensions 38 of the cover member 24 are provided adjacent to some of the solder pad portions 41 of the base part 22 and further the extensions 38 are bonded to the mounting area of the motherboard 20 by soldering, together with the solder pad portions 41. Thereby, if the excessive external force F is applied to the push button switch 21 from the direction as shown in FIG. 8, the external force can be received and supported by the entire mounting portions M. In particular, because in some of the mounting portions M, each have a combined planar space of a solder pad portion 41 and an extension 38, it is possible to set the amount of solder applied to a large value and stably maintain a high mechanical bonding intensity.

As shown in FIGS. 5 and 6, by positioning the extensions 38 in the direction perpendicular to the sliding direction of the operating controller 25, a stress at the time a large external force is applied to the push button switch 21 through the push-button part 32 can be supported by the extensions 38 extending in a direction across a sliding direction of the operating controller 25, thus preventing a risk of breakage of the switch by excessive pressures on the cover member 24 and the base part 22 to be raised from the motherboard 20.

Moreover, by bonding the extensions 38 extending from the side portions of the cover member 24 and some of the solder pad portions together as mounting portions M on a motherboard, the bonding positions of the cover member 24 and the base part 22 are aligned, and thus the cover member 24 and the base part 22 are bonded with higher intensity to the motherboard 20. Consequently, it is possible for the push button switch 21 to maintain sufficient bonding intensity with connected and extended bonding areas, even if the extensions 38 themselves have small bonding portions.

Furthermore, it is possible to mount a push button switch according to the present invention in a limited area of a motherboard 20, and therefore mobile phones and other small electronic devices can be miniaturized or thinned.

In the illustrated embodiment, to increase intensity of fixation from the side of the push-button part 32 which is the part of the push button switch 21 most easily affected by impact, the extensions 38 provided on the cover member 24 are configured to be disposed adjacent to the pair of solder pad portions 41 provided at a lower surface of the base part 22. If such a push button switch 21 is structured to have an even greater intensity of fixation, the cover member 24 can be configured to provide additional extensions 38 which are disposed adjacent to a pair of solder pad portions 41 provided on a lower side of the base part 22, in addition to the extensions 38 disposed adjacent to the solder pad portions 41 disposed on the lower surface of the base part 22.

In the push button switch 21 according to the present invention, because the solder pad portions 41 provided on the lower surface of the base part 22 and extensions 38 of the cover member 24 covering the base part 22 are disposed adjacently, it is possible to bond one of the solder pad portions 41 and one of the extensions 38 by soldering together as connected mounting portions M when the push button switch is mounted on a motherboard. Consequently, stronger bonding of the solder pad portions 41 and the extensions 38 can be accomplished to prevent the base part 22 and the cover member 24 from easily being separated from the motherboard, even if a large external force such as dropping or the like is applied to the operating controller 25.

In addition, because the extensions 38 and some of the solder pad portions 41 are bonded to a motherboard as connected mounting portions M respectively, the extensions 38 have sufficient bonding strength even if the extensions 38 each have a small area. Consequently, it is possible to keep a mounting space of the push button switch 21 small in an electronic device, while the push button switch becomes impact-resistant.

As mentioned above, because the lower surface of the extensions of the cover member 24 is bonded by soldering together with the adjacent solder pad portions 41, it is possible to easily bond the extensions of the cover member 24 and the solder pad portions of the circuit board 26 of the base part 22 to a motherboard through a reflow process by previously applying solder plating to the lower surfaces of extensions of the cover member 24 and the solder pad portions of the circuit board.

Although the preferred embodiments of the present invention have been described, it should be understood that the present invention is not limited to these embodiments, and that various modifications and changes can be made to the embodiments.

For example, in the push button switch 21 in the aforementioned embodiment, the base part 22 is structured by a combination of the circuit board 26 made of epoxy resin and the mold frame 30 in which the snap dome 23*b*, the fixed contact 23*a*, and the operating controller 25 are contained, but the circuit board 26 may be replaced by a lead frame including external connecting terminals.

In this case, the push button switch 21 is structured by using a molded base part, which may be formed by inserting the lead frame.

A push button switch structured using the molded base part formed based on the lead frame has a bonding strength to the motherboard that is similar to that of push button switch 21, by providing a cover body including extension portions disposed adjacent to portions corresponding to the exterior connecting terminals of the lead frame.

What is claimed is:

1. A push button switch, comprising:

a base part;

a fixed contact provided on the base part;

a snap dome provided on the base part to cover the fixed contact;

a cover member disposed to cover at least one portion of the base part; and an operating controller disposed in the base under the cover member and configured to perform switch-on and -off operations of electrical connection between the snap dome and the fixed contact, the cover member including at least a pair of side extended portions extending downwardly along sides of the base part, and extensions extending laterally along a same level of a lower surface of the base part, the base part including at a lower surface thereof solder pad portions, at least two of the solder pad portions electrically connected to the snap dome and the fixed contact.

2. The push button switch according to claim 1, wherein the operating controller is laterally inserted in an opening disposed at a peripheral side surface of the push button switch.

3. The push button switch according to claim 2,
wherein the opening is provided in at least one side surface of the cover member.

4. The push button switch according to claim 2,
wherein the operating controller includes a press stick and is configured to be slid in a lateral direction to press the snap dome downwardly.

5. The push button switch according to claim 2,
wherein the solder pad portions provided on the lower surface of the base part are positioned at both sides of the opening in which the operating controller is inserted.

6. The push button switch according to claim 5,
wherein the extensions of the cover member are disposed adjacent to some of the solder pad portions respectively.

7. The push button switch according to claim 1,
wherein each of the extensions of the cover member includes a lower surface extending in a same plane as a lower surface of each of the solder pad portions.

8. The push button switch according to claim 1,
wherein the base part includes a circuit board.

9. A push button switch, comprising:
a base part including a circuit board having an upper surface and a lower surface;
a fixed contact provided on the upper surface of the circuit board;
a snap dome provided on the upper surface of the circuit board to cover the fixed contact;
a cover member disposed to cover at least one portion of the base part; and
an operating controller disposed between the circuit board and the cover member configured to perform switch-on and -off operations of electrical connection between the snap dome and the fixed contact,
the cover member including an upper part and at least one pair of side extended portions extending downwardly from the upper part along opposite side surfaces of the base part,
the circuit board including solder pad portions provided on the lower surface of the circuit board and at least one pair of the solder pad portions electrically connected to the snap dome and the fixed contact,
the side extended portions at downwardly extended ends thereof including at least two extensions each disposed adjacent to one of the solder pad portions, respectively, and
each of the extensions including a lower surface in a same plane as a lower surface of the circuit board with the solder pad portions provided.

10. The push button switch according to claim 9,
wherein the cover member includes a slope extending from the upper part of the covering member into an inside of the push button switch,
the operating controller includes a pressing portion extending inside the push button switch, a leading end of the pressing portion including a contacting surface that contacts with the slope, and
the contacting surface includes a portion inclined along the slope.

11. An electronic device, comprising:
the push button switch as recited in claim 1; and
a motherboard on which the push button switch is mounted,
the push button switch being electrically connected to the motherboard and fixed to the motherboard at the extensions and the solder pad portions.

12. The electronic device according to claim 11,
wherein the extensions are fixed to the motherboard by soldering.

13. The electronic device according to claim 11,
wherein the extensions and the solder pad portions adjacent to the extensions are fixed together to the motherboard by soldering.

14. An electronic device, comprising:
the push button switch according to claim 9; and
a motherboard on which the push button switch is mounted,
the extensions of the cover member of the push button switch being fixed to the motherboard by soldering.

15. The electronic device according to claim 14,
wherein the extensions and the solder pad portions adjacent to the lower surfaces of the extensions are fixed together respectively to the motherboard by soldering.

16. The electronic device according to claim 15,
wherein the solder pad portions include four solder pad portions that are disposed on two sides adjacent to four corners of the circuit board, and the four solder pad portions are fixed to the motherboard by soldering.

* * * * *

UNITED STATES PATENT AND TRADEMARK OFFICE

CERTIFICATE OF CORRECTION

PATENT NO. : 8,124,902 B2
APPLICATION NO. : 12/370647
DATED : February 28, 2012
INVENTOR(S) : Watanabe It is certified that error appears in the above-identified patent and that said Letters Patent is hereby corrected as shown below:

At section (73) Assignee, correct the incorrect assignee name by deleting "Citizen Electronics Co., Ltd" and insert --Citizen Electronics Co., Ltd.--.

Signed and Sealed this
Fourth Day of September, 2012

David J. Kappos

David J. Kappos
*Director of the United States Patent and Trademark Office*